US006126482A

United States Patent [19]

Stabile

[11] Patent Number: 6,126,482

[45] Date of Patent: Oct. 3, 2000

[54] RIGHT ANGLE COAXIAL CABLE CONNECTOR

[75] Inventor: David J. Stabile, Horseheads, N.Y.

[73] Assignee: Thomas & Betts International, Inc., Sparks, Nev.

[21] Appl. No.: 09/179,184

[22] Filed: Oct. 27, 1998

Related U.S. Application Data

[60] Provisional application No. 60/063,805, Oct. 31, 1997.

[51] Int. Cl.[7] ..... H01R 9/05

[52] U.S. Cl. ..... 439/582; 439/578

[58] Field of Search ..... 439/582, 578, 439/579, 580, 581, 583, 584, 585, 271

[56] References Cited

U.S. PATENT DOCUMENTS

| | | | |
|---|---|---|---|
| 2,933,714 | 4/1960 | Overholser | 439/582 |
| 2,952,823 | 9/1960 | Robinson | 439/582 |
| 3,196,382 | 7/1965 | Morello, Jr. | 439/585 |
| 3,432,798 | 3/1969 | Brishka | 439/582 |
| 5,439,386 | 8/1995 | Ellis et al. | 439/271 |
| 5,499,934 | 3/1996 | Jacobsen et al. | 439/585 |
| 5,651,699 | 7/1997 | Holliday | 439/582 |
| 5,769,662 | 6/1998 | Stabile et al. | 439/578 |
| 5,860,833 | 1/1999 | Chillscyzn et al. | 439/585 |

*Primary Examiner*—Gary F. Paumen
*Assistant Examiner*—Tho D. Ta
*Attorney, Agent, or Firm*—Weingarten, Schurgin, Gagnebin & Hayes LLP

[57] ABSTRACT

A right angle coaxial connector is comprised of a unitary body piece, a terminal, an insert, a post, a stem, a nut, a plurality of insulators and an o-ring. The connector is useful for providing interconnection of a coaxial cable to a port. The unitary body has an open first end with a first bore extending with in the first end. The second end of the body has a second bore which is generally perpendicular to, and intersects with the first bore. The post is disposed within the first bore as is a first insulator. First insulator supports a first end of the terminal. The terminal features a bend of approximately ninety degrees and has a second end adapted to receive a conductor therein, and a first end, perpendicular to the second end which extends outside the connector. A second insulator is provided at the bend of the terminal where the first bore meets the second bore and protects the terminal from being bent back and shorting against the body during installation of the connector. An insert fits into the second bore of the body. A stem is fit into the insert and the insulator is fit inside the stem and insulates the terminal from the stem. The nut is attached to and rotatable about the stem and includes a threaded section for mating of the connector to a port. In use, a coaxial cable having a prepared end is inserted into he open end of the unitary body. The center conductor of the coaxial cable connector is mechanical and electrical communication with the terminal. The shield of the coaxial cable is in electrical communication with the post. The open end of the body is then crimped to mechanically secure the cable within the connector cable within the connector. An o-ring is provided between the nut and the insert to provide a moisture proof seal.

A second embodiment is similar to the first embodiment except that the insert has been removed, the stem is press fit into the second bore of the unitary body with the nut rotatable about the stem. An o-ring is provided between the nut and the insert to provide a moisture proof seal.

17 Claims, 6 Drawing Sheets

RIGHT ANGLE COAXIAL CABLE CONNECTOR

CROSS REFERENCE TO RELATED APPLICATIONS

This application claims priority under 35 U.S.C. §119(e) to Provisional Application No. 60/063,805, filed Oct. 31, 1997; the disclosure of which is incorporated herein by reference.

STATEMENT REGARDING FEDERALLY SPONSORED RESEARCH OR DEVELOPMENT

Not Applicable

BACKGROUND OF THE INVENTION

Coaxial cable connectors are typically straight in shape in that they extend along the same central axis as the cable they are attached. Accordingly, for the cables with the connectors attached to be mated with ports, the cables must be arranged generally perpendicular to the surface of the ports. The routing of the cables must take this into consideration, and in certain instances can result in requiring additional room, since the cables themselves are not flexible enough to provide a sharp bend at the connector. It would be desirable to have a connector so that a coaxial cable can be positioned in a non-perpendicular arrangement with respect to a port in order to mate with the port.

BRIEF SUMMARY OF THE INVENTION

A right angle coaxial connector is comprised of a unitary body piece, a terminal, an insert, a post, a stem, a nut, a plurality of insulators and an o-ring. The connector is useful for providing interconnection of a coaxial cable to a port. The terminal features a bend of approximately ninety degrees and has a first end adapted to receive a conductor therein, and a second end, perpendicular to the first end which extends outside the connector for connecting to a port. In use, a coaxial cable having a prepared end is inserted into he open end of the unitary body. The center conductor of the coaxial cable connector is mechanical and electrical communication with the terminal. The shield of the coaxial cable is in electrical communication with the post. The open end of the body is then crimped to mechanically secure the cable within the connector. A second embodiment is similar to the first embodiment except that the insert has been removed, the stem is press fit into the second bore of the unitary body with the nut rotatable about the stem. In both embodiments an o-ring can be provided between the nut and the insert to provide a moisture proof seal.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
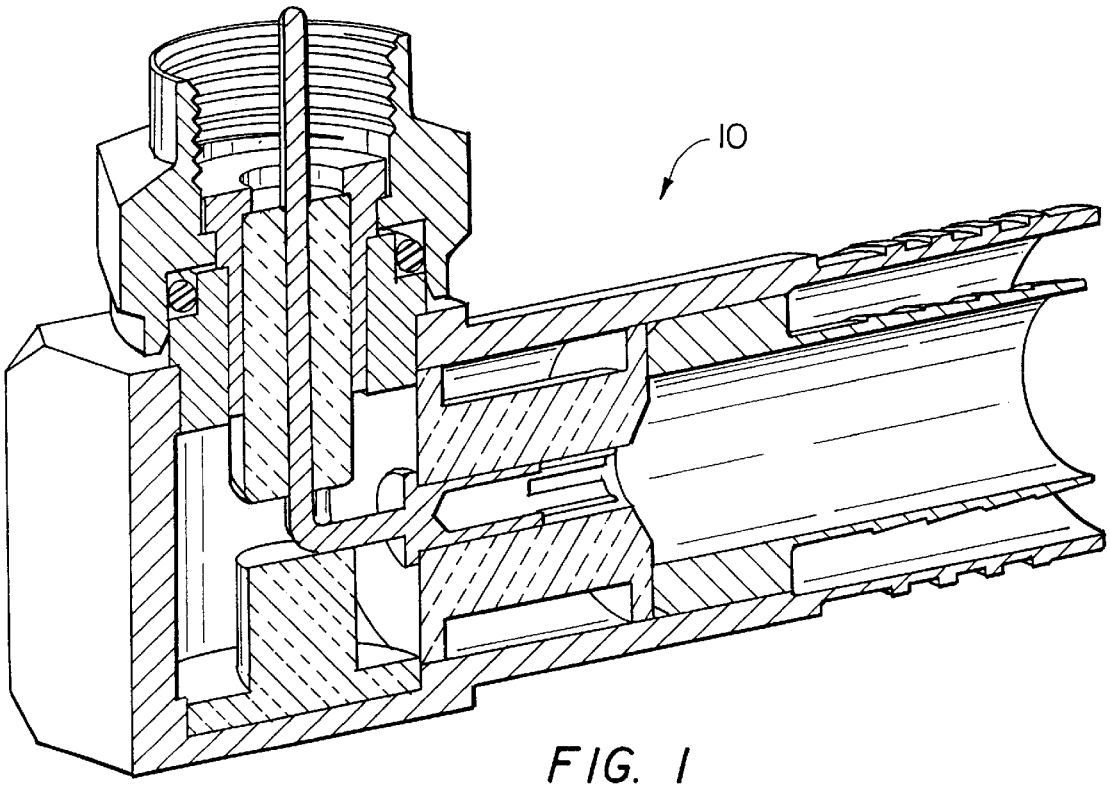
FIG. 1 is a cut-away side view of the right angle coaxial connector of the present invention.
Figure 2:
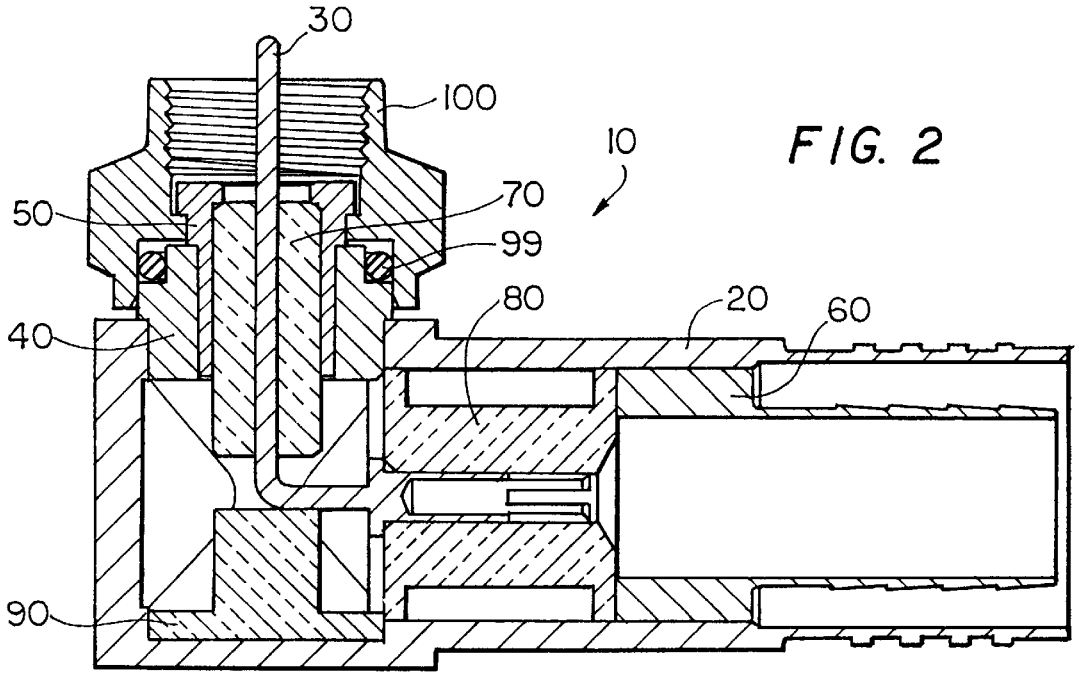
FIG. 2 is a cross sectional view of the right angle coaxial connector of FIG. 1.

A right angle coaxial connector 10, shown in FIGS. 1 and 2 includes a unitary body piece 20, a terminal 30, an insert 40, a stem 50, a post 60, a nut 100, a plurality of insulators 70, 80 and 90 and an o-ring 99. The connector 10 is useful for providing interconnection of a coaxial cable to a port.

Figure 3B:
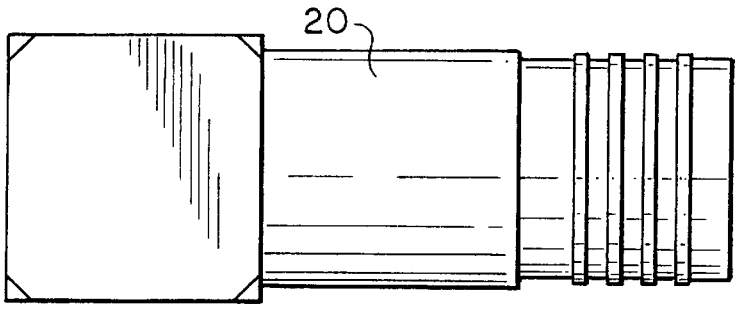
FIG. 3B is a top view of the body of FIG. 3A.
Figure 3C:
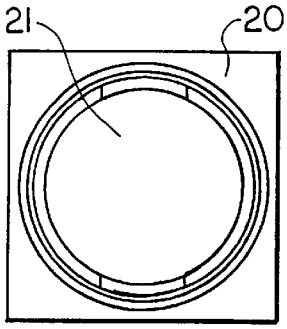
FIG. 3C is an end view of the body of FIG. 3A.
Figure 3A:
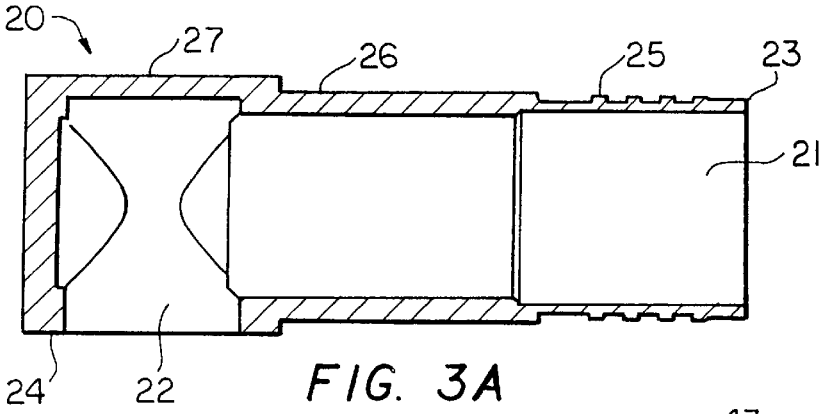
FIG. 3A is a cross sectional view of the body of the present connector.

Referring now to FIGS. 3A–3C, the unitary body 20 has an open first end 23 with a first bore 21 extending a predetermined distance within the body 20 from the first end 23. The second end 24 of the body 20 has a second bore 22 which is generally perpendicular to, and intersects with the first bore 21. The first portion 26 of body 20 is generally tubular, while the second portion 27 is generally square. The first end further includes a section 25 which has a reduced thickness in certain areas to allow crimping of the first end onto a cable inserted therein. In a preferred embodiment, body 20 may be comprised of a conductive material, such as brass.

Figure 4A:
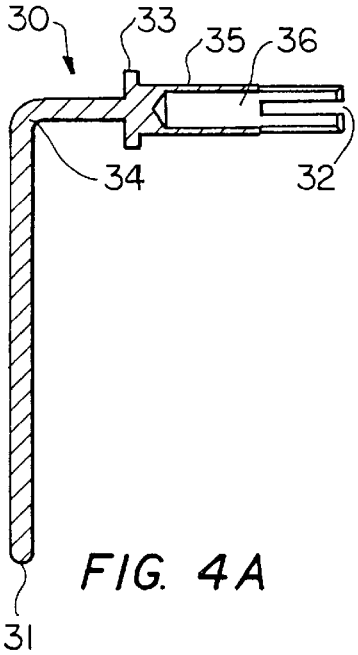
FIG. 4A is a cross sectional side view of the terminal of the present connector.
Figure 4B:
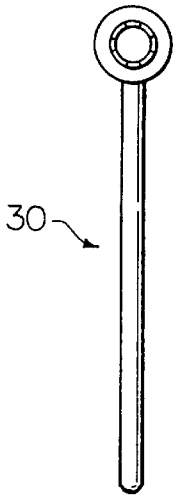
FIG. 4B is an end view of the terminal of FIG. 4A.

Referring now to FIGS. 4A and 4B terminal 30 is shown. Terminal 30 features a bend 34 of approximately ninety degrees, such that the first end 31 is non-linear with a second end 32 and is disposed within the body such that the second end is within the first portion of the body 20, while the first end extends beyond the top surface of body 20. Second end 32 is adapted to receive a conductor therein, and includes a bore 36 disposed a predetermined distance therein and plurality of fingers 35 surrounding the bore 36. An annular shoulder 33 is formed as part of the terminal 30. The first end 31 is shown as rounded, although various shaped ends could also be utilized. Terminal 30 is comprised of a conductive material, such as brass.

Figure 5A:
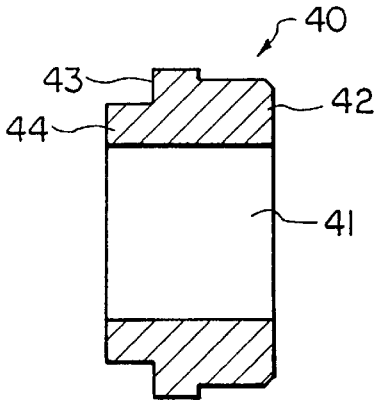
FIG. 5A is a cross sectional side view of the press insert of the present connector.
Figure 5B:
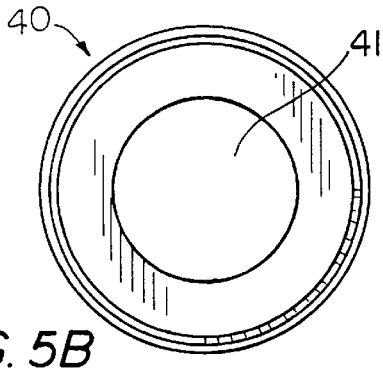
FIG. 5B is an end view of the press insert of FIG. 5A.

An insert 40 is shown in FIGS. 5A and 5B. Insert 40 is generally circular in shape and has a central bore 41 disposed therethrough. A first end 42 has a first diameter, while second end 44 has a diameter smaller than that of first end 42. As a result an annular shoulder 43 is formed as part of insert 40. The first end 42 of insert 40 is configured to be press fit into the second bore 22 of body 20. Insert 40 is comprised of a conductive material, such as brass.

Figure 6A:
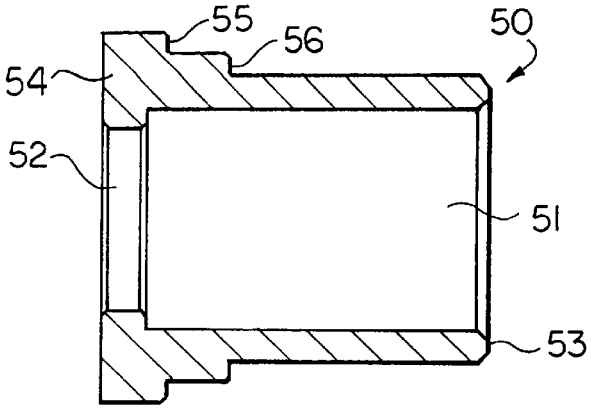
FIG. 6A is a cross sectional side view of the stem of the present connector.
Figure 6B:
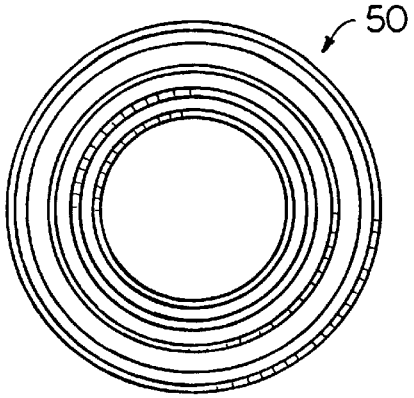
FIG. 6B is a end view of stem of FIG. 6A.

The stem 50 is shown in FIGS. 6A and 6B. Stem 50 is generally cylindrical in shape and includes a first central bore 51 disposed partially therein from the first end 53, and a second central bore 52 extending from the second end 54 to the first central bore 51. The first end 53 has a diameter sized to fit within the central bore of insert 40. Stem 50 further includes a first annular shoulder 56 and a second annular shoulder 55. Stem 50 is comprised of a conductive material, preferably brass.

Figure 7A:
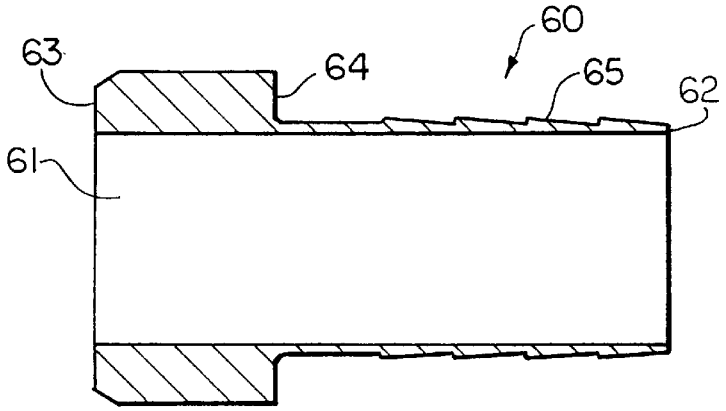
FIG. 7A is a cross sectional side view of the post of the present connector.
Figure 7B:
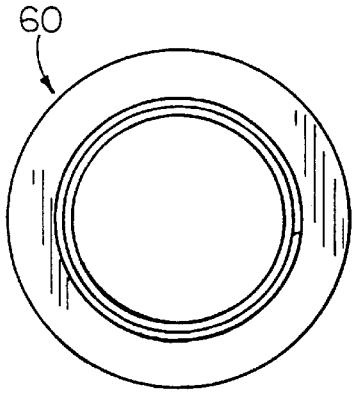
FIG. 7B is end view of the post of FIG. 7A.

Referring now to FIGS. 7A and 7B, post 60 is shown. Post 60 is generally cylindrical and includes a central bore 61 disposed therethrough. Post 60 is disposed within the first central bore of body 20. The first end 63 has a diameter adapted to fit between a sheath and dielectric of a coaxial cable when a cable is inserted into the connector. The second 62 has a diameter adapted to fit within the first central bore of body 20. Post 60 may further include a plurality of wedge shaped protrusions 65 for providing increased mechanical and electrical communication to the sheath of the coaxial cable. Post 60 also includes an annular shoulder 64 which function as a stop when the coaxial cable is inserted within the connector. Post 60 is comprised an electrically conductive material such as brass.

Figure 8A:
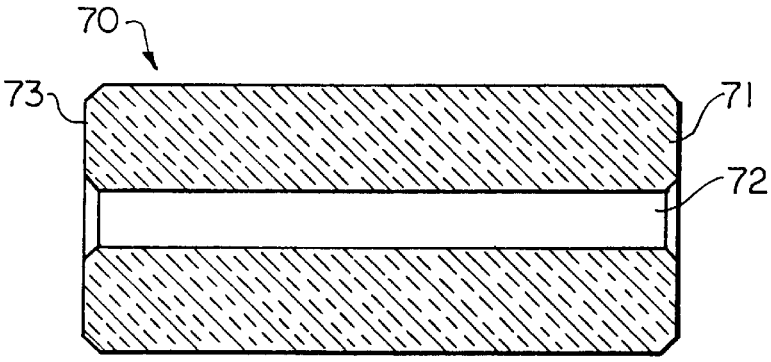
FIG. 8A is a cross sectional side view of a first insulator.
Figure 8B:
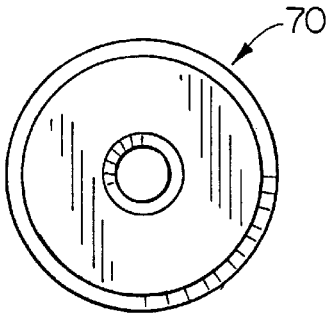
FIG. 8B is an end view of the first insulator of FIG. 8A.

Referring now to FIGS. 8A and 8B, a first insulator 70 is shown. First insulator 70 is generally tubular in shape and has a central bore 72 extending from first end 71 to second end 73. The central bore 72 is sized to fit around a portion of terminal 30. The first insulator itself is configured to fit within the first central bore of stem 50, and to electrically and mechanically insulate terminal 30 from stem 50. First insulator 70 is comprised of a nonconductive material.

Figure 9A:
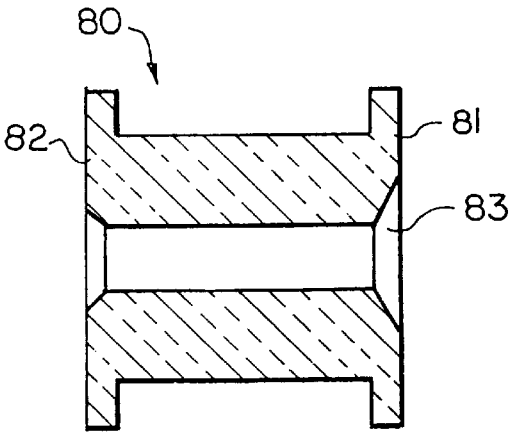
FIG. 9A is a cross sectional side view of a second insulator of the present connector.
Figure 9B:
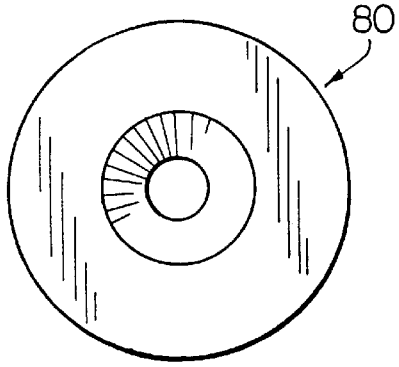
FIG. 9B is an end view of the second insulator of FIG. 9A.

Second insulator 80 is shown in FIGS. 9A and 9B. Second insulator 80 has a generally cylindrical shape and includes a central bore 83 disposed therethrough. The central bore 83 is configured to receive the second end of terminal 30 therein. Second insulator 80 is configured the fit within the first central bore of body 20 with the first end 81 abutting the post 60, and the second end 82 abutting the shoulder of terminal 30. Second insulator 80 is comprised of a nonconductive material.

Figure 10A:
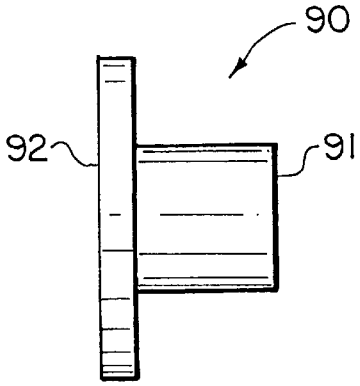
FIG. 10A is a side view of a base insulator of the present connector.
Figure 10B:
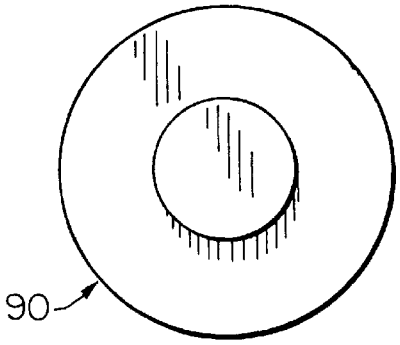
FIG. 10B is an end view of a base insulator of 10A.

Base insulator 90 is shown in FIGS. 10A and 10B. Base insulator has a first end 91 and a second larger end 92. The larger end 92 is sized to fit with in the second bore of body 20, and the length of base insulator is such that a portion of the terminal rests on first end 91. Accordingly, the base insulator provides mechanical and electrical insulation of terminal 30 within the second bore of body 20. Base insulator is comprised of a nonconductive material.

Figure 11A:
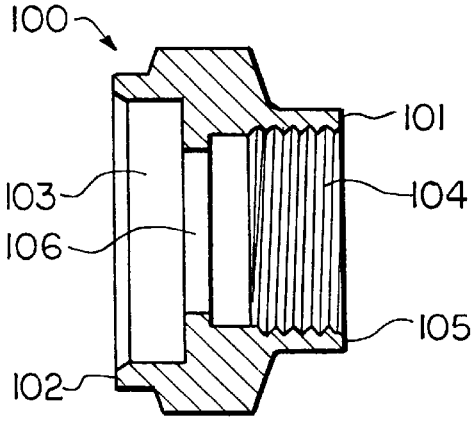
FIG. 11A is a cross sectional side view of the nut of the present connector.
Figure 11B:
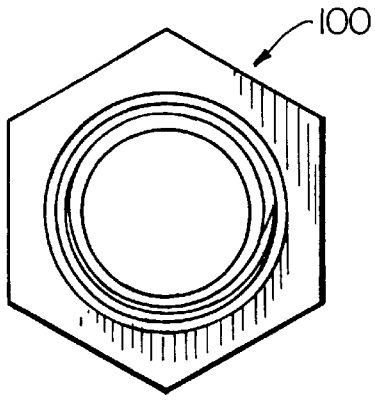
FIG. 11B is an end view of the nut of FIG. 11A.

Show in FIGS. 11A and 11B is nut 100. Nut 100 includes a first central bore 104 extending a predetermined distance within the first end 101. A plurality of threads 105 are included as part of first central bore 104. A second central bore 103 extends a predetermined distance within a second end 102 of nut 100. A third central bore 106 extends from the first central bore 104 to the second central bore 103. The first central bore is sized to receive and retain the second end of stem 50 therein. The third central bore fits the area of the stem 50 between the first and second annular shoulders of the stem 50. The second central bore receives a portion of insert 40 therein. Nut 100 is rotatable about stem 50 and insert 40. Nut 100 further includes a hexagonal portion which aids in hand or tool tightening of the nut to a cooperating port. Nut 100 is comprised of a conductive material such as brass.

An o-ring 99 is provided between the nut 100 and the insert 40 and provides an substantially moisture proof seal between the nut 100 and the insert 40. O-ring 99 is comprised of a generally resilient material.

Figure 12:
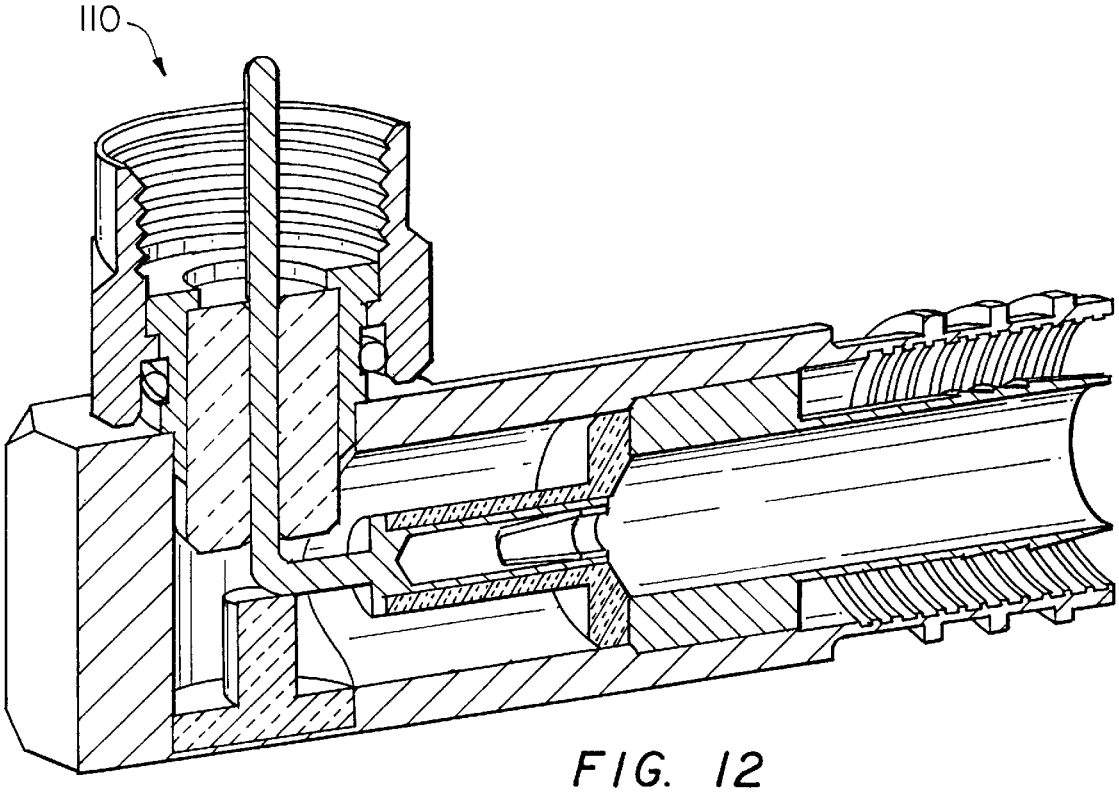
FIG. 12 is a cut-away side view of a second embodiment of the right angle coaxial connector.
Figure 13A:
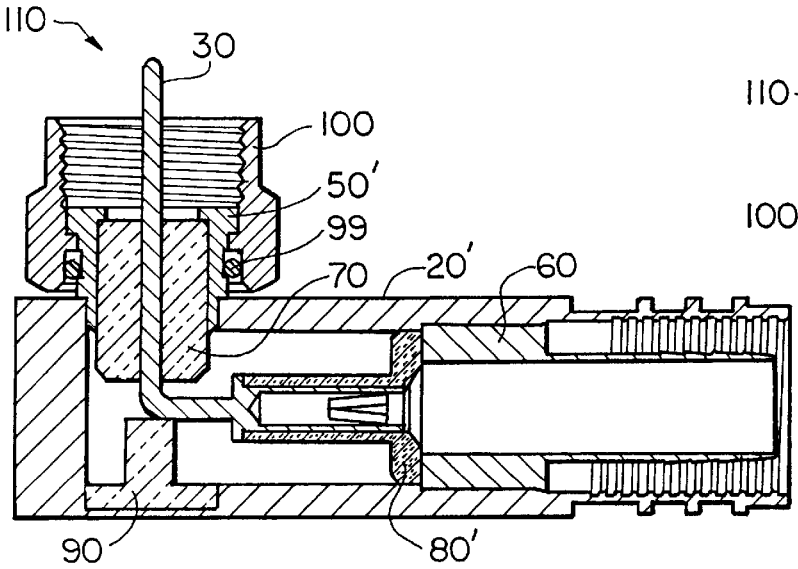
FIG. 13A is a cross sectional side view of the second embodiment of the right angle coaxial connector of the present invention.
Figure 13B:
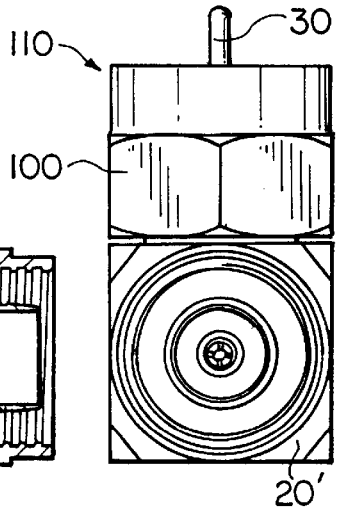
FIG. 13B is an end view of the right angle coaxial connector of FIG. 13A.

A second embodiment 110 of the right angle coaxial cable adapter is shown in FIGS. 12, 13A and 13B. This embodiment is similar to the first embodiment 100 except that the insert has been removed, the stem is press fit into the second bore of the unitary body with the nut 100 rotatable about the stem 50'. An o-ring 99 is provided between the nut and the stem 50' to provide a moisture proof seal.

Figure 14A:
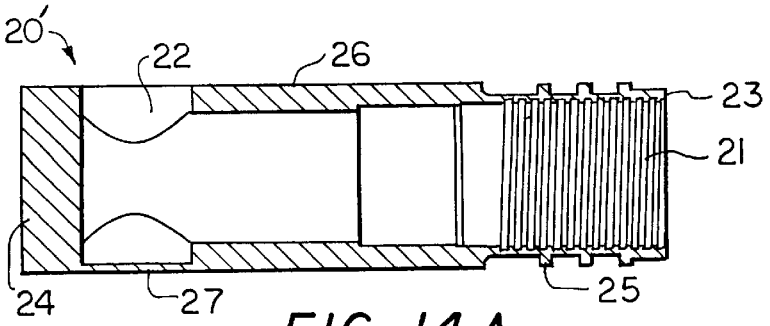
FIG. 14A is a cross sectional side view of the body of the connector of FIG. 12.
Figure 14B:
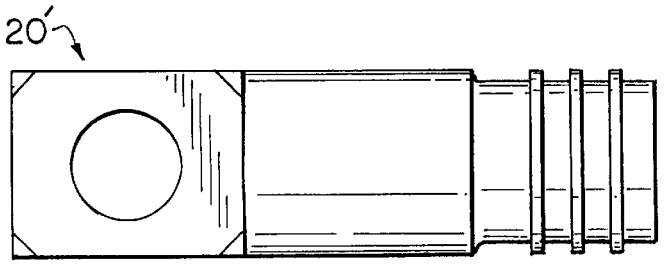
FIG. 14B is the top view of the body of FIG. 14A.
Figure 14C:
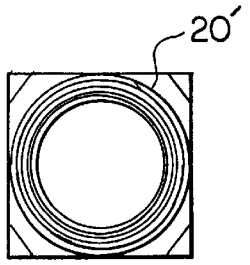
FIG. 14C is an end view of the body of FIG. 14A.

Referring now to FIGS. 14A–14C, body 20' is shown. Body 20' has an open first end 23 with a first bore 21 extending a predetermined distance within the body 20' from the first end 23. The second end 24 of the body 20' has a second bore 22 which is generally perpendicular to, and intersects with the first bore 21. The first portion 26 of body 20 is generally tubular, while the second portion 27 is generally square. The first end further includes a section 25 which has a reduced thickness in certain areas to allow crimping of the first end onto a cable inserted therein. The first end 21 also includes a plurality of threads which are useful in securing the body to the coaxial cable. In a preferred embodiment, body 20' may be comprised of a conductive material, such as brass.

Figure 15A:
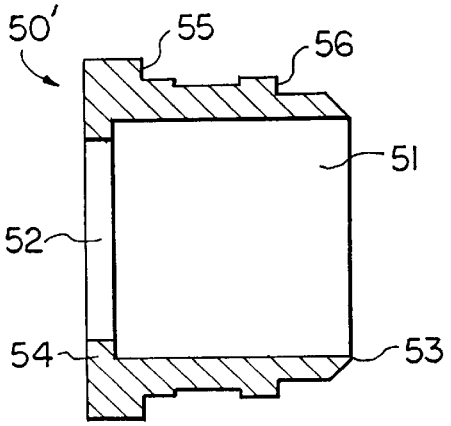
FIG. 15A is a cross sectional side view of the stem of the second embodiment of the right angle coaxial connector.
Figure 15B:
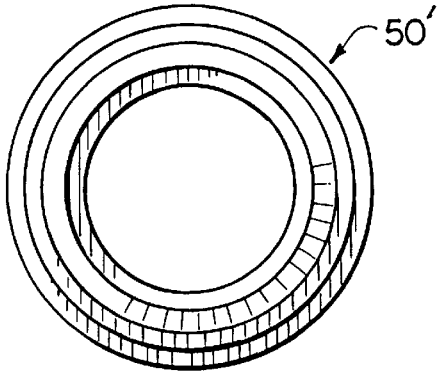
FIG. 15B is an end view of the stem of FIG. 15A.

Stem 50' is shown in FIGS. 15A and 15B. Stem 50' is generally cylindrical in shape and includes a first central bore 51 disposed partially therein from the first end 53, and a second central bore 52 extending from the second end 54 to the first central bore 51. The first end 53 has a diameter sized to fit within the second bore of body 20'. Stem 50' further includes a first annular shoulder 56 and a second annular shoulder 55. Stem 50' is comprised of a conductive material such as brass.

Figure 16A:
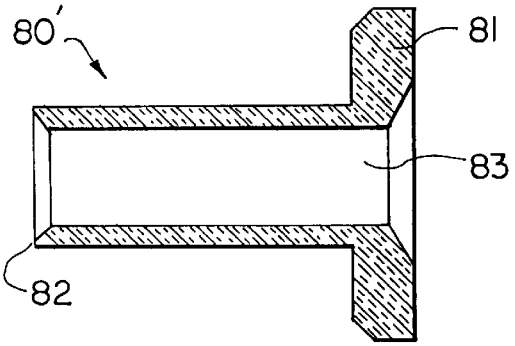
FIG. 16A is a cross sectional side view of the second insulator of the second embodiment of the right angle coaxial connector.
Figure 16B:
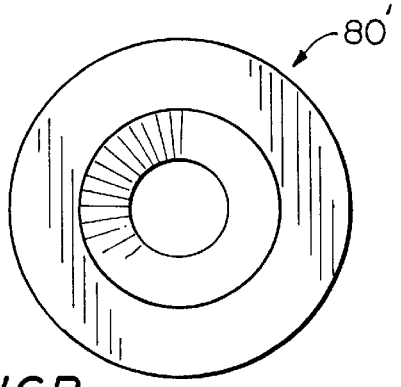
FIG. 16B is an end view of the second insulator FIG. 16A.

Second insulator 80' is shown in FIGS. 16A and 16B. Second insulator 80' has a generally cylindrical shape and includes a central bore 83 disposed therethrough. The central bore 83 is configured to receive the second end of terminal 30 therein. Second insulator 80' is configured to fit within the first central bore of body 20' with the first end 81 abutting the post 60, and the second end 82 abutting the shoulder of terminal 30. Second insulator 80 is comprised of a nonconductive material.

The right angle coaxial cable connector 10 and 110 receive a prepared end of a coaxial cable therein. A center conductor of the cable is received within and placed in mechanical and electrical communication with terminal 30. The post 60 fits between the dielectric layer of the cable and the conductive sheath. The first end of body 20 is crimped which mechanically secures the connector to the cable, while also providing mechanical and electrical communication between the conductive sheath and the post. The second end of the connector is secured to a cooperating port by threading the nut onto the port, thus placing the terminal in electrical communication with the port. With such a configuration, cable do not have to be routed such that they are perpendicular to the surface having ports, but can be routed parallel to the surfaces having the cooperating ports, savings space and reducing cable length and signal or power loss.

Having described preferred embodiments of the invention it will now become apparent to those of ordinary skill in the art that other embodiments incorporating these concepts may be use. Accordingly, it is submitted that the invention should not be limited to the described embodiments but rather should be limited only by the spirit and scope of the pending claims.

I claim:

1. A right angle coaxial connector comprising:

a body having a first end, a second end, a top surface, a first central bore partially disposed through said second end, and a second bore disposed within said top surface adjacent said first end, said first bore intersecting said second bore wherein an outside surface of said first end includes areas of reduced cross section adapted to be crimped into engagement with a cable;

a nut having a central bore disposed there through, said nut rotatably disposed adjacent said top surface of said body, said central bore of said nut disposed along a common axis with said second bore of said body;

a post having a central bore disposed there through, said post disposed within said first central bore of said body;

a terminal disposed within said body, having a first end and a second end, said second end of said terminal substantially perpendicular to said first end of said terminal, said second end of said terminal having an annular bore and a plurality of fingers adapted to crimpably receive a conductor of said cable therein, said first end of said terminal extending beyond said nuts;

a stem disposed along the common central axis within said nut and said second bore, said nut rotatable about said stem; and a press insert disposed along the common central axis within said second bore, said stem disposed within said insert.

2. The right angle coaxial connector of claim 1 further comprising a first insulator disposed within said body and said nut, said first insulator surrounding a portion of said terminal.

3. The right angle coaxial connector of claim 1 further comprising a second insulator disposed within said body, said second insulator surrounding said second end of said terminal.

4. The right angle coaxial connector of claim 1 further comprising a base insulator disposed within said body, said base insulator supporting a portion of said terminal.

5. The right angle coaxial connector of claim 1 further comprising an o-ring disposed between said nut and said stem.

6. The right angle coaxial connector of claim 1 wherein said body, said nut, said terminal, said post and said stem are comprised an electrically conductive material.

7. The right angle connector of claim 6 wherein said electrically conductive material comprises brass.

8. The right angle coaxial connector of claim 1 wherein said body, said nut, said terminal, said post, said stem and said insert are comprised an electrically conductive material.

9. The right angle connector of claim 8 wherein said electrically conductive material comprises brass.

10. A right angle coaxial connector comprising:

a body having a first end, a second end, a top surface, a first central bore partially disposed through said second end, and a second bore disposed within said top surface adjacent said first end, said first bore intersecting said second bore wherein an outside surface of said first end includes areas of reduced cross section adapted to be crimped into engagement with a cable;

a nut having a central bore disposed there through, said nut rotatably disposed adjacent said top surface of said body, said central bore of said nut disposed along a common axis with said second bore of said body;

a post having a central bore disposed there through, said post disposed within said first central bore of said body;

a terminal disposed within said body, having a first end and a second end, said second end of said terminal substantially perpendicular to said first end of said terminal, said second end of said terminal having an annular bore and a plurality of fingers adapted to crimpably receive a conductor of said cable therein, said first end of said terminal extending beyond said nut;

a stem disposed along said common central axis within said nut and said second bore, said nut rotatable about said stem;

a press insert disposed along said common central axis within said second bore, said stem disposed within said insert;

a first insulator disposed within said body and said nut, said first insulator surrounding a portion of said terminal;

a second insulator disposed within said body, said second insulator surrounding said second end of said terminal; and a base insulator disposed within said body, said base insulator supporting a portion of said terminal.

11. The right angle coaxial connector of claim 10 further comprising an o-ring disposed between said nut and said stem.

12. The right angle coaxial connector of claim 10 wherein said body, said nut, said terminal, said post, said stem and said insert are comprised an electrically conductive material.

13. The right angle connector of claim 12 wherein said electrically conductive material comprises brass.

14. A right angle coaxial connector comprising:

a body having a first end, a second end, a top surface, a first central bore partially disposed through said second end, and a second bore disposed within said top surface adjacent said first end, said first bore intersecting said second bore;

a nut having a central bore disposed there through, said nut rotatably disposed adjacent said top surface of said body, said central bore of said nut disposed along a common central axis with said second bore of said body;

a post having a central bore disposed there through, said post disposed within said first central bore of said body;

a terminal disposed within said body, having a first end and a second end, said second end of said terminal substantially perpendicular to said first end of said terminal, said second end of said terminal having an annular bore and a plurality of fingers adapted to crimpably receive a conductor of said cable therein, said first end of said terminal extending beyond said nut;

a stem disposed along said common central axis within said nut and said second bore, said nut rotatable about said stem;

a first insulator disposed within said body and said nut, said first insulator surrounding a portion of said terminal;

a second insulator disposed within said body, said second insulator surrounding said second end of said terminal; and a base insulator disposed within said body, said base insulator supporting a portion of said terminal.

15. The right angle coaxial connector of claim 14 further comprising an o-ring disposed between said nut and said stem.

16. The right angle coaxial connector of claim 14 wherein said body, said nut, said terminal, said post and said stem are comprised an electrically conductive material.

17. The right angle connector of claim 16 wherein said electrically conductive material comprises brass.

* * * * *

UNITED STATES PATENT AND TRADEMARK OFFICE

CERTIFICATE OF CORRECTION

PATENT NO. : 6,126,482
DATED : October 3, 2000
INVENTOR(S) : David J. Stabile

It is certified that error appears in the above-identified patent and that said Letters Patent is hereby corrected as shown below:

Column 4,
Line 58, "80" read -- 80´ --; and

Column 5,
Line 40, "nuts;" should read -- nut; --.

Signed and Sealed this

First Day of January, 2002

*Attest:*

*Attesting Officer*

JAMES E. ROGAN
*Director of the United States Patent and Trademark Office*